US007531727B2

(12) United States Patent
Buttemer

(10) Patent No.: US 7,531,727 B2
(45) Date of Patent: May 12, 2009

(54) CHIN REST FOR MUSICAL INSTRUMENT

(76) Inventor: Evan D. Buttemer, 1454 Bracken Ave., Victoria, BC (CA) V8X 3N8

( * ) Notice: Subject to any disclaimer, the term of this patent is extended or adjusted under 35 U.S.C. 154(b) by 46 days.

(21) Appl. No.: 11/618,384

(22) Filed: Dec. 29, 2006

(65) Prior Publication Data

US 2007/0175309 A1 Aug. 2, 2007

Related U.S. Application Data

(60) Provisional application No. 60/755,179, filed on Dec. 30, 2005.

(51) Int. Cl.
*G10D 1/02* (2006.01)

(52) U.S. Cl. ..... 84/278; 84/279; 84/281

(58) Field of Classification Search ..... 84/278–281
See application file for complete search history.

(56) References Cited

U.S. PATENT DOCUMENTS

| | | | |
|---|---|---|---|
| 104,405 | A | 6/1870 | Avery |
| 156,613 | A | 11/1874 | White |
| 160,136 | A | 2/1875 | Albert |
| 213,804 | A | 4/1879 | Barnes |
| 217,330 | A | 7/1879 | Bull |
| 360,408 | A | 4/1887 | Becker |
| 368,893 | A | 8/1887 | Lowenthal |
| 409,842 | A | 8/1889 | Hoelscher |
| 439,199 | A | 10/1890 | Schuster |
| 451,744 | A | 5/1891 | Albert |
| 550,386 | A | 11/1895 | Davis |
| 560,053 | A | 5/1896 | Strong |
| 576,950 | A | 2/1897 | Coloney |
| 651,436 | A | 6/1900 | Coffron |
| 925,068 | A | 6/1909 | Ziegler |
| 931,251 | A | 8/1909 | Beisheim |
| 932,844 | A | 8/1909 | Beisheim |
| 1,023,234 | A | 4/1912 | Williams |
| 1,156,925 | A | 10/1915 | Poehland |
| 1,204,642 | A | 11/1916 | Becker |
| 1,311,670 | A | 7/1919 | Watson |

(Continued)

FOREIGN PATENT DOCUMENTS

| | | | |
|---|---|---|---|
| CA | 2284807 | A1 | 3/1901 |

(Continued)

*Primary Examiner*—Jeffrey Donels
*Assistant Examiner*—Christopher Uhlir
(74) *Attorney, Agent, or Firm*—Stevens & Showalter LLP

(57) ABSTRACT

A chin rest for a musical instrument comprises a body, a first support, a second support, a chin pad and a third support. The first support extends from a first end portion of the body and has at least one clamping member for engaging an upper rim of a musical instrument body. Similarly, the second support extends from a second end portion of the body and has at least one clamping member for engaging the upper rim of the musical instrument body in a position spaced from the first support. The chin pad includes a chin receiving surface for receiving a chin of a performer of the musical instrument, and is coupled to the body. The third support may contact a position along the upper rim of the musical instrument, e.g., between the first and second supports when the chin rest is mounted to a corresponding instrument.

20 Claims, 10 Drawing Sheets

U.S. PATENT DOCUMENTS

| | | | | | |
|---|---|---|---|---|---|
| 1,315,015 | A | | 9/1919 | Doyle | |
| 1,332,621 | A | | 3/1920 | Ganiere | |
| 1,387,216 | A | | 8/1921 | Wallace | |
| 1,416,644 | A | | 5/1922 | Jordan | |
| 1,431,007 | A | | 10/1922 | Kenne | |
| 1,473,672 | A | | 11/1923 | Dittmann | |
| 1,477,030 | A | * | 12/1923 | Boyd | 84/278 |
| 1,570,361 | A | | 1/1926 | Wallace | |
| 1,721,919 | A | | 7/1929 | Meyers | |
| 1,786,478 | A | | 12/1930 | Connell | |
| 1,821,811 | A | | 9/1931 | Mai | |
| 1,879,386 | A | | 9/1932 | Medakovic | |
| 1,920,850 | A | | 8/1933 | Ebert | |
| 1,971,552 | A | | 8/1934 | Fisher | |
| 2,057,825 | A | | 10/1936 | Hardy | |
| 2,061,464 | A | | 11/1936 | Heimers | |
| 2,064,925 | A | | 12/1936 | Kolitsch | |
| 2,110,023 | A | | 3/1938 | McGowan | |
| 2,216,052 | A | | 9/1940 | Spetseris | |
| 2,223,221 | A | * | 11/1940 | Miranda | 84/279 |
| 2,248,854 | A | | 7/1941 | Coffeen et al. | |
| 2,478,530 | A | | 8/1949 | Hall | |
| 2,483,052 | A | | 9/1949 | Humphrey | |
| 2,486,646 | A | | 11/1949 | Halko | |
| 2,489,101 | A | | 11/1949 | Mills | |
| 2,489,321 | A | | 11/1949 | Nyhagen | |
| 2,524,526 | A | | 10/1950 | Hines | |
| 2,591,164 | A | | 4/1952 | Klein | |
| 2,652,739 | A | | 9/1953 | Hall | |
| 2,697,374 | A | | 12/1954 | Ungh | |
| 2,746,336 | A | | 5/1956 | Bisharat | |
| 2,747,452 | A | | 5/1956 | Goldberger | |
| 3,090,275 | A | | 5/1963 | Menuhin et al. | |
| 3,175,446 | A | | 3/1965 | Menuhin et al. | |
| 3,372,614 | A | | 3/1968 | Galster | |
| 3,479,916 | A | | 11/1969 | Wolf | |
| 3,532,023 | A | | 10/1970 | Fiechtner | |
| 3,631,754 | A | | 1/1972 | Kun | |
| 3,683,098 | A | * | 8/1972 | Chavez, Jr. | 84/278 |
| 3,727,509 | A | | 4/1973 | Henkle | |
| 3,728,928 | A | | 4/1973 | Looser | |
| 3,896,694 | A | | 7/1975 | Goldner | |
| D247,642 | S | | 3/1978 | Watson | |
| D254,012 | S | | 1/1980 | Lenski | |
| 4,212,222 | A | | 7/1980 | Henkle | |
| 4,248,125 | A | | 2/1981 | Everett | |
| 4,333,378 | A | | 6/1982 | Hrdlicka | |
| 4,334,455 | A | | 6/1982 | Beecher | |
| 4,386,548 | A | | 6/1983 | Wolf | |
| 4,389,916 | A | | 6/1983 | Ruthstrom | |
| 4,506,582 | A | | 3/1985 | Goldner | |
| 4,534,259 | A | | 8/1985 | Wolf | |
| 4,884,487 | A | * | 12/1989 | Feldkamp | 84/280 |
| D305,547 | S | | 1/1990 | McMillan | |
| 4,951,541 | A | | 8/1990 | McMillan | |
| D334,019 | S | | 3/1993 | Kun | |
| 5,208,409 | A | | 5/1993 | Roulet | |
| D338,222 | S | | 8/1993 | Steinberger | |
| 5,270,474 | A | | 12/1993 | Kun | |
| 5,275,078 | A | | 1/1994 | Wolf | |
| 5,341,714 | A | * | 8/1994 | Roulet | 84/278 |
| D352,053 | S | | 11/1994 | Murray | |
| 5,377,573 | A | | 1/1995 | Tretick | |
| 5,415,070 | A | | 5/1995 | Kaman | |
| 5,419,226 | A | | 5/1995 | Kun | |
| 5,507,213 | A | | 4/1996 | Beseke | |
| 5,567,893 | A | | 10/1996 | Kun | |
| D385,292 | S | | 10/1997 | Kun | |
| D390,252 | S | | 2/1998 | Burward-Hoy et al. | |
| 5,731,531 | A | | 3/1998 | Kun | |
| 5,780,756 | A | | 7/1998 | Babb | |
| D406,269 | S | | 3/1999 | Mach | |
| 5,883,315 | A | | 3/1999 | Kaplan et al. | |
| 5,939,652 | A | | 8/1999 | Jones | |
| 6,031,163 | A | | 2/2000 | Cullum et al. | |
| 6,143,964 | A | | 11/2000 | Chen | |
| 6,239,337 | B1 | | 5/2001 | Stein | |
| 6,268,555 | B1 | * | 7/2001 | Vochezer | 84/279 |
| 6,278,044 | B1 | * | 8/2001 | Ruan | 84/279 |
| 6,291,750 | B1 | | 9/2001 | Farha | |
| 6,369,303 | B1 | | 4/2002 | Hvezda | |
| 6,481,022 | B1 | | 11/2002 | D'Addario et al. | |
| 6,667,430 | B1 | * | 12/2003 | Liao | 84/279 |
| 6,670,533 | B1 | | 12/2003 | Yeh | |
| 6,680,431 | B2 | | 1/2004 | Vanden et al. | |
| 6,756,531 | B2 | | 6/2004 | Ruann | |
| 6,891,083 | B1 | | 5/2005 | Huang | |
| 6,927,328 | B2 | | 8/2005 | Anderson | |
| 6,927,329 | B2 | | 8/2005 | Chen | |
| 2003/0167896 | A1 | | 9/2003 | Vanden et al. | |
| 2004/0011182 | A1 | | 1/2004 | Ruan | |
| 2005/0016355 | A1 | | 1/2005 | Huang | |
| 2005/0066791 | A1 | | 3/2005 | Anderson | |
| 2005/0066792 | A1 | | 3/2005 | Mea | |
| 2005/0120860 | A1 | | 6/2005 | Chen | |
| 2005/0183564 | A1 | | 8/2005 | Ripley | |

FOREIGN PATENT DOCUMENTS

| | | | |
|---|---|---|---|
| CA | 2000453 | | 4/1990 |
| CA | 2007745 | | 7/1991 |
| CA | 2198320 | A1 | 8/1998 |
| CA | 2202828 | A1 | 10/1998 |
| CA | 2226191 | A1 | 1/1999 |
| CH | 686205 | A5 | 1/1996 |
| CN | 2041848 | U | 7/1989 |
| CN | 1441945 | | 9/2003 |
| CZ | 12490 | U | 10/2002 |
| DE | 3210739 | | 12/1982 |
| DE | 3210739 | A1 | 12/1982 |
| DE | 3205292 | A1 | 1/1983 |
| DE | 3205292 | | 9/1983 |
| DE | 3415724 | | 11/1985 |
| DE | 3415724 | A1 | 11/1985 |
| DE | 4137917 | A1 | 4/1992 |
| DE | 43 02 804 | C1 | 3/1994 |
| DE | 4328066 | A1 | 3/1994 |
| DE | 19532900 | A1 | 3/1997 |
| DE | 19717338 | | 9/1997 |
| DE | 19835675 | | 6/1999 |
| DE | 19909972 | | 9/1999 |
| EP | 0180069 | A2 | 10/1985 |
| EP | 0287520 | A1 | 4/1988 |
| EP | 0353824 | A1 | 7/1989 |
| EP | 0540978 | A1 | 10/1992 |
| EP | 0567050 | A1 | 4/1993 |
| FR | 2688919 | | 9/1993 |
| GB | 16243 | | 3/1899 |
| GB | 11080 | | 5/1901 |
| GB | 5289 | | 5/1908 |
| GB | 5179 | | 8/1915 |
| GB | 108283 | | 8/1917 |
| GB | 181219 | | 6/1922 |
| GB | 227637 | | 1/1925 |
| GB | 161451 | | 4/1927 |
| GB | 413545 | | 7/1934 |
| GB | 447576 | | 5/1936 |
| GB | 676196 | | 7/1952 |
| GB | 744673 | | 2/1956 |
| GB | 954359 | | 4/1964 |
| GB | 1160313 | | 8/1969 |
| GB | 1501912 | | 2/1978 |
| GB | 2244587 | A | 12/1991 |
| GB | 2264191 | A | 8/1993 |

| | | | |
|---|---|---|---|
| HK | 1058989 | | 11/2005 |
| IT | 1271906 | | 6/1997 |
| JP | 58-147793 | | 9/1983 |
| JP | 7-271352 | | 10/1995 |
| JP | 2004-263356 | A | 9/2004 |
| LT | 95015 | | 8/1996 |
| RO | 113500 | | 7/1998 |
| RO | 113500 | B | 7/1998 |
| RU | 2077740 | C1 | 4/1997 |
| SE | 8006226-8 | | 2/1982 |
| SI | 9300209 | A | 12/1994 |
| SU | 1327159 | A1 | 7/1987 |
| SU | 1434486 | A1 | 10/1988 |
| SU | 1441455 | A1 | 11/1988 |
| SU | 1443025 | A1 | 12/1988 |
| SU | 1534499 | A1 | 1/1990 |
| SU | 1603434 | A1 | 10/1990 |
| SU | 1737502 | A1 | 5/1992 |
| TW | 412718 | | 11/2000 |
| WO | WO 91/11800 | | 8/1991 |
| WO | WO 01/71705 | A1 | 9/2001 |
| WO | WO 02/35192 | A1 | 5/2002 |
| WO | WO 03/100763 | A1 | 12/2003 |
| WO | WO 2004/077398 | A1 | 9/2004 |
| WO | WO 2004/077399 | A1 | 9/2004 |

* cited by examiner

CHIN REST FOR MUSICAL INSTRUMENT

BACKGROUND OF THE INVENTION

The present invention relates in general to chin rests for musical instruments, and more particularly, to a chin rest that provides adjustability, can improve the sonorous tone produced by a corresponding instrument and/or that is conveniently mounted onto and removed from a corresponding instrument.

A conventional chin rest for a musical instrument, such as a violin or viola, comprises a generally arcuate chin pad that is attached to a generally "C" shaped clamp. The chin rest is typically installed on a corresponding instrument such that the clamp grips an edge of a top surface (belly) and an edge of a bottom surface (back) of the instrument near an endpin of the instrument so as to position the chin pad to receive the chin of the performer when the instrument is held in a performance position.

The clamp typically includes an upper clamping member that threadably secures to a lower clamping member using one or more threaded posts and corresponding connecting components. To tighten or release the pressure of the clamp on the instrument, the connecting components must be turned with a small tool, such as a screwdriver or a specialty tool, which fits into holes on the sides of the connecting components. However, the clamp is close to the instrument itself. Thus, a required tool may not make a full turn when removing or attaching a chin rest from a corresponding instrument. Rather, a new adjustment or repositioning of the tool may be required, e.g., every quarter-turn, of the connecting component. Thus, the process of attaching and/or removing a conventional chin rest to an instrument can be a time consuming and arduous task. Accordingly, a performer may not take the time to position the chin rest to an optimal position for that performer.

Additionally, care must be taken when attaching or removing a conventional chin rest to avoid causing damage to the instrument. It can be difficult to keep a chin rest clamp positioned properly during the securement operation described above. Moreover, if the clamp slips, it is possible that either the clamp or the tool used to tighten or loosen the clamp can scratch or otherwise damage the instrument. Still further, when a conventional chin rest is left on an instrument over an extended period of time, e.g., a period of years or decades, the clamp can leave a mark or indentation on the belly and/or back of the instrument.

BRIEF SUMMARY OF THE INVENTION

According to an aspect of the present invention, a chin rest for an instrument comprises a body having a first end portion and a second end portion that is opposite of the first end portion. A first support extends from the first end portion of the body and a second support extends from the second end portion of the body, where each of the first and second supports include at least one clamping member. Also, a third support extends from the body between the first end portion and the second end portion. Further, a chin pad having a chin receiving surface is coupled to the body between the first end portion and the second end portion. The chin rest is configured such that the clamping members of the first and second supports apply sufficient force to an upper rim of a musical instrument to temporarily clamp the chin rest to the musical instrument when the chin rest is mounted on the musical instrument.

According to another aspect of the present invention, a chin rest for an instrument comprises a body, a first support, a second support, a third support and a chin pad. The first support extends from a first end portion of the body and has at least one clamping member and at least one adjustable feature. The second support extends from a second end portion of the body and has at least one clamping member. The third support extends from the body between the first and second supports. Further, the chin pad coupled to the body. The chin rest is configured such that the clamping members of the first and second supports apply sufficient force to an upper rim of a musical instrument to temporarily clamp the chin rest to the musical instrument when the chin rest is mounted on the musical instrument and the adjustable feature of the first support enables the chin pad to be continuously variably positionable about a predetermined range of the upper rim of the body.

According to yet another aspect of the present invention, a chin rest for a musical instrument comprises a body, a first support that extends from the first end portion of the body and a second support that extends from the second end portion of the body, where each of the first and second supports include at least one clamping member. A chin pad having a chin receiving surface is coupled to the body and a third support extends from the body between the first and second supports. The chin rest is configured such that when the chin rest is installed on a corresponding musical instrument, the body spans across a tail piece of the musical instrument, the at least one clamping member of the first support engages an upper rim of the musical instrument on a first side of the tail piece, the at least one clamping member of the second support engages the upper rim on a second side of the tail piece opposite of the first side and the third support is either in contact with or proximate to the upper rim.

DETAILED DESCRIPTION OF THE INVENTION

In the following detailed description, reference is made to the accompanying drawings that form a part hereof, and in which is shown by way of illustration, and not by way of limitation, specific aspects of the invention. It is to be understood that changes may be made without departing from the spirit and scope of various embodiments of the present invention.

Figure 1:
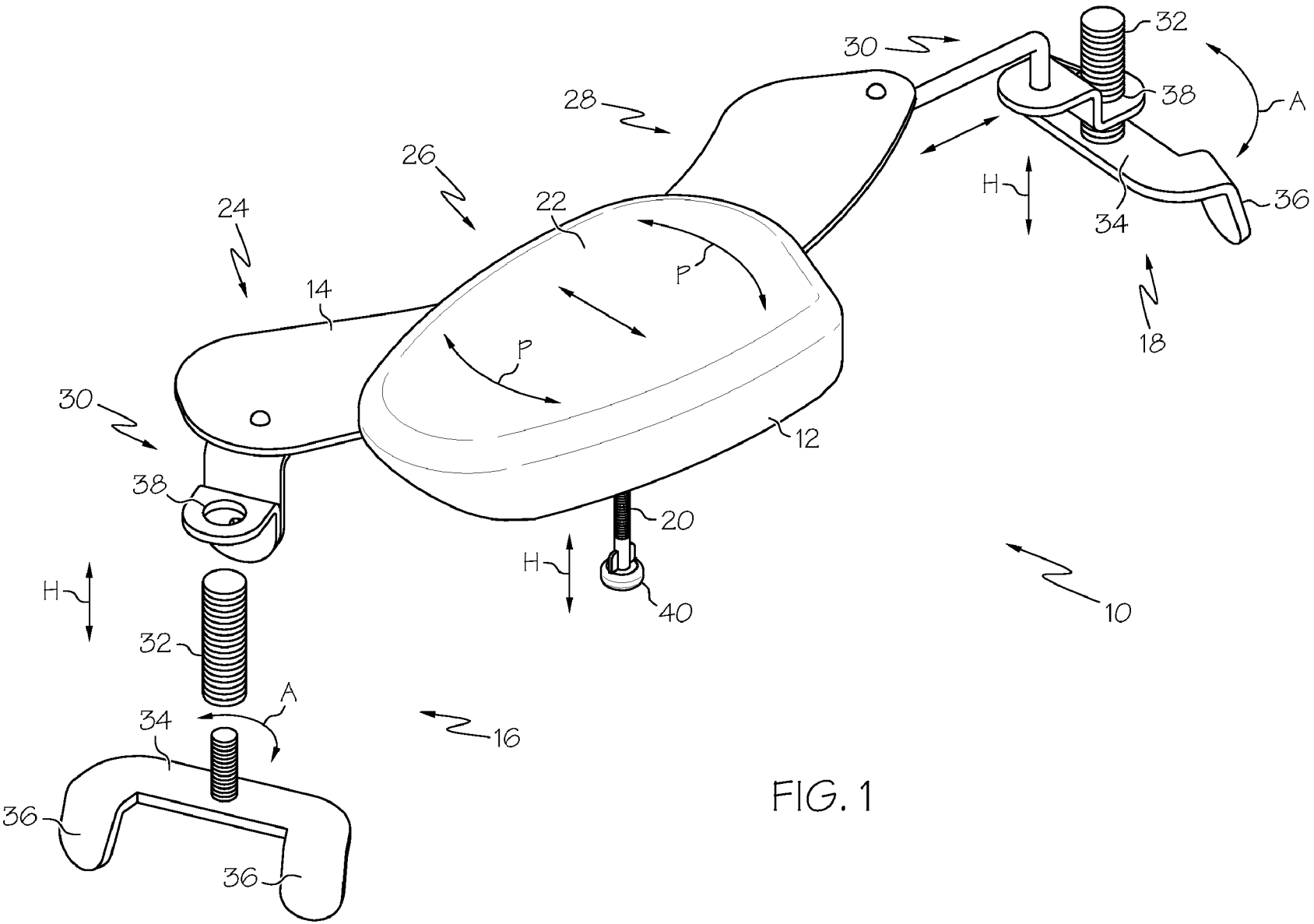
FIG. 1 is a view of a chin rest according to an aspect of the present invention.

Referring now to the drawings, and particularly to FIG. 1, a chin rest 10 for use with a musical instrument is illustrated. According to various aspects of the present invention, the chin rest 10 comprises a chin pad 12, a body (also referred to herein as a bridge) 14, a first support 16, a second support 18 and a third support 20. The chin pad 12 includes a contoured support surface 22, such as a generally concave or other suitably shaped portion to receive the chin of a performer. The chin pad 12 and corresponding support surface 22 can be any size and/or shape that accommodates the chin of a performer when the chin rest 10 is suitably mounted to a musical instrument (described in greater detail below). Further, the chin pad 12 may be constructed using any suitable materials or combination of materials, such as wood, polymers, etc.

The body 14 provides a main supporting surface for the components of the chin rest 10 and includes generally, a first end portion 24, a middle portion 26 and a second end portion 28. For example, as illustrated, the first end portion 24 is generally opposite of the second end portion 28 and the middle portion is generally between the first end portion 24 and the second end portion 28. The chin pad 12 is coupled to the body 14 generally about the middle portion 26 or generally between the first end portion 24 and the middle portion 26, the first support 16 extends from the main body 14 about the first portion 24, the second support extends from the body 14 about the second portion 28, and the third support 20 extends from the body 14 between the first and second supports 16, 18. Further, the body 14 may be constructed using any suitable materials or combination of materials, such as wood, metal, polymers, etc.

In the exemplary chin rest 10 illustrated in FIG. 1, the first and second supports 16, 18 cooperate to temporarily clamp, i.e., secure, associate, support or otherwise hold the chin rest 10 to a corresponding instrument (not shown in FIG. 1). As such, the first and second supports 16, 18 may also be referred to as clamps or clamp assemblies, etc. As will be seen in greater detail herein, by "temporarily", it is meant that the chin rest 10 is associated with a corresponding instrument so as to be readily mounted to or removed from the instrument and/or readily adjusted with respect to the instrument. For example, the chin rest 10 may remain mounted to a corresponding instrument for extended periods of time if desired by the performer. Alternatively, the chin rest 10 may be readily removed from the instrument, for example, each time the instrument is packed into a corresponding case for transportation. Still further, the chin rest 10 may be readily and repeatedly mounted to and removed from one or more instruments, such as where a performer is experimenting with different chin rest positions and/or instruments.

In general, the first and second supports 16, 18 each define an assembly that includes a shoulder 30, an arm 32, an intermediate member 34, and one or more clamping members 36 (two clamping members 36 as shown coupled to each intermediate member 34). The shoulder 30 attaches to a corresponding end portion of the body 14. For example, as shown, the shoulder 30 of the first support 16 attaches to the first end portion 24 of the body 14 and the shoulder 30 of the second support 18 attaches to the second end portion 28 of the body 14. The arm 32 extends generally down and/or out from the shoulder 30 and away from the body 14. The intermediate member 34 attaches to the arm 32, such as at an end thereof, opposite the shoulder 30, and the clamping members 36 extend generally downward and away from the intermediate member 34. Thus, the intermediate member 34 forms a furcation that spaces the clamping members 36 of each support 16, 18. As will be described in greater detail below, the clamping members 36 may serve as fingers that cooperate with their corresponding intermediate member 34 to contact an upper rim of a musical instrument when the chin rest 10 is mounted thereon.

The arm 32 may comprise an externally threaded portion that is threadably received through a corresponding female threaded aperture 38 in the shoulder 30. As such, the height of the clamping members 36 may be quickly and readily adjusted, as indicated generally by the reference H, designating a height adjustment capability. For example, the height of the body 14 relative to the clamping members 36 may be infinitely variability within a specific range of height adjustment by screwing the arm 32 either up or down through the threaded aperture 38 of the shoulder 30.

In this regard, the intermediate member 34 may be fixedly secured to the arm 32, or the intermediate member 34 may be mounted to the arm 32 such that the arm 32 and the intermediate member 34 may be independently adjusted or repositioned, e.g., using a suitable threaded member, pin, bearing, swivel joint, ball joint or other appropriate connection structure that allows the intermediate member 34 to rotate independently of the arm 32.

As an example, with reference to the first support 16, the arm 32 may be a threaded member such as an intermediate cylinder component, which is threaded on both an inside surface and an outside surface. The outside surface of the intermediary cylinder component threads into the shoulder 30 that is mounted to the body 14 as described above. Moreover, the intermediate member 34 may further include a threaded protrusion that threads into the inside surface of the intermediate cylinder component. This arrangement allows both height adjustments of the clamping members 36 relative to the body 14 by adjusting the arm 32 with respect to the shoulder 38, as well as rotational adjustments of the clamping members 36 relative to the corresponding shoulder 30 and body 14. Thus, the clamping members 36 may be adjusted to the contours of the corresponding instrument, such as by rotating the intermediate member 34 relative to the arm 32.

The body 14 of the exemplary chin rest 10 is a generally elongate member having a slight curve about its middle portion 26, thus defining a slight "U" shape. However, the body 14 may alternatively exhibit a handle bar shape relative to the first and second end portions 24, 28 or take on any other desired shape.

The chin pad 12 is shown generally in the vicinity of the middle portion 26, slightly towards the first end portion 24 for purposes of illustration. However, the chin pad 12 may be positioned generally anywhere between the first and second end portions 24, 28. Moreover, the chin pad 12 may be fixedly or adjustably mounted to the body 14, e.g., using any of a variety of adhesives, mechanical fastening arrangements, etc.

For example, the chin pad 12 may be adjustable, e.g., mounted to the body 14 so as to be pivotable in one or more dimensions as indicated generally by the reference arrow P. For example, a screw may be provided, which can be tightened to lock the chin pad 12 in a desired position relative to the body 14, or the screw may be loosened for repositioning the chin pad 12. Under this arrangement, the body 14 may have one or more slots or other features for facilitating adjustment of the chin pad 12. Other structures may alternatively be utilized to couple the chin pad 12 to the body 14, including for example, a pin, bearing, ball and joint or other attachment configuration. Moreover, the chin pad 12 may be repositionable along the surface of the body 14. Thus, the angle and position of the chin support surface 22 may be varied in relation to a corresponding instrument, e.g., in either discrete steps or over an infinitely variable angle/position within specific, predefined range(s).

Figure 2:
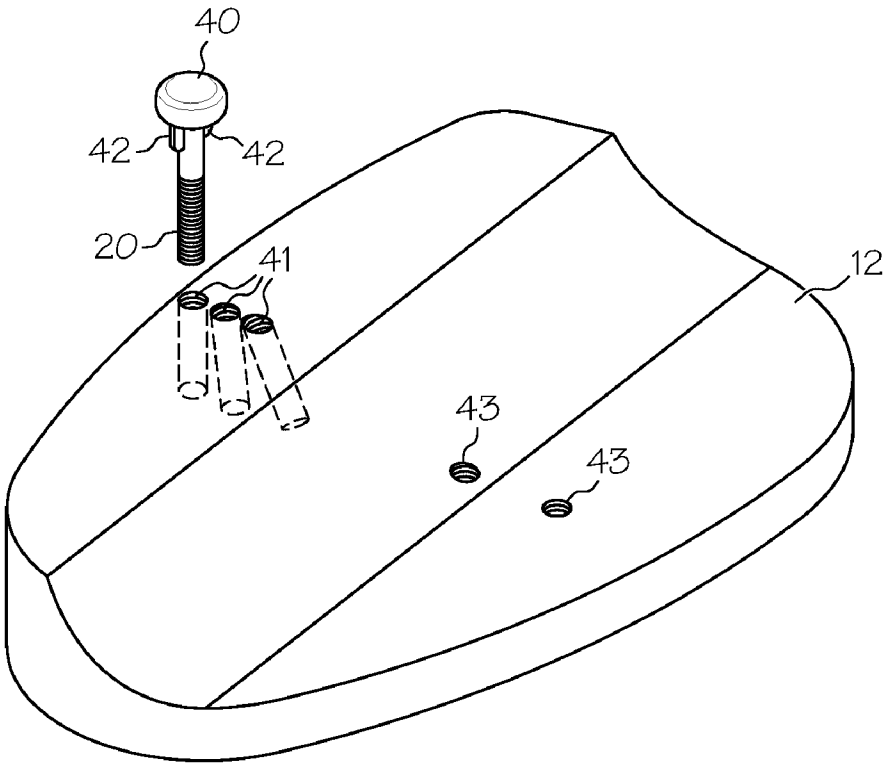
FIG. 2 is a view of the underside of a chin pad illustrating the attachment of a floating support thereto.

With reference to FIGS. 1 and 2, the third support 20 may extend generally downward and provide a floating support for the chin rest 10. Thus, the third support 20 is also referred to herein as a floating support 20. (In FIG. 2, the chin pad 12 is flipped upside down to illustrate features of the third support 20. Under this configuration, the floating support 20 may comprise an externally threaded member that allows the floating support 20 to provide a height adjustment feature. The floating support 20 may thread into the chin pad 12 or the floating support may thread through an attachment member provided by or extending from the body 14. For example, as best seen in FIG. 2, one or more holes 41 may be provided in the underside of the chin pad 12. A threaded portion of the floating support 20 is screwed up or down through a select one of the holes 41 to provide a height and position adjusting feature of the third support. Such adjustments may be made, for example, to accommodate a desired height of the chin pad relative to a corresponding instrument, and/or to compensate for adjustments of the chin pad 12 relative to the body 14 of the chin rest 10. Still further, one or more of the holes 41 may be angled.

As will be described in greater detail herein, the third support 20 may contact the instrument at or close to the edge thereof when the chin rest 10 is mounted to a corresponding instrument. By providing angled holes, the chin pad 12 may be positioned over the belly of the instrument, yet the third support 20 may still angle back to the edge of the instrument. Alternatively, the third support 20 may include an adjustment feature so that contact of the third support 20 remains on or proximate to the instrument edge regardless of the position of the chin pad 12. The floating support 20 may alternatively utilize other height adjustment techniques, including those described with reference to the arms 32. The chin pad 12 also shows some exemplary taps or threaded opening 43, which may be used, for example, to secure the chin pad 12 to the body 14.

Also as shown, the floating support 20 comprises an end cap 40. The end cap 40 is optional, but may provide protection to an instrument upon which the chin rest 10 is attached. For example, the end cap 40 may comprise rubber, wood, polymers, cloth, felt, leather or other material or composition that is applied, at least to the underside of the floating support 20.

With brief reference to FIG. 2, the floating support 20 may further comprise a convenient grasp area, such as when adjusting the height of the floating support 20 by providing a grasp surface 42 that is easy to grasp and maintain control of while adjusting the height of the floating support 20. The grasp surface 42 may be provided on the floating support 20 or the end cap 40, and may comprise wings, flares or other surfaces to facilitate height adjustments of the floating support 20. The end cap 40 may further be utilized to minimize and/or provide isolation of the floating support 20 from the area of the floating support 20 that lies in contact with the instrument when the chin rest 10 is mounted on a corresponding instrument as will be described in greater detail below.

Figure 3:
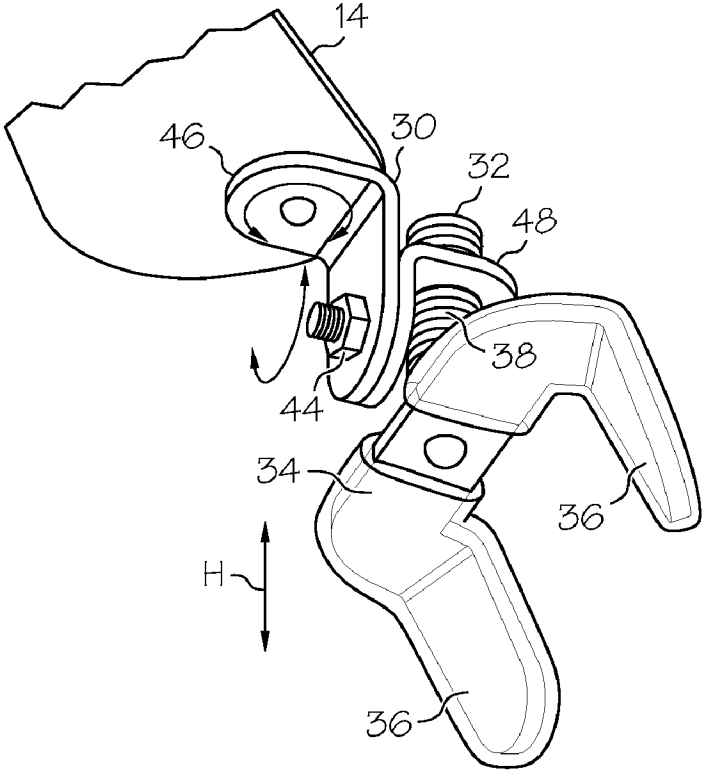
FIG. 3 is a view of an exemplary support arrangement usable with the chin rest of FIG. 1.

The first and/or second supports 16, 18 may be implemented by any number of support arrangements. With reference to FIG. 3, a first exemplary support arrangement is illustrated. The configuration shown in FIG. 3 allows the shoulder 30 to rotate relative to the body 14 as demonstrated by the rotational arrow. The illustrative shoulder 30 comprises an adjusting member 44 that secures two shoulder components 46, 48 together. This configuration may allow the two shoulder components 46, 48 to pivot, tilt, height adjust or otherwise be configured relative to one another.

For example, the shoulder components 46, 48 may have slots therein and the adjusting member 44 may pass through the respective slots. Accordingly, an adjustment may be made, such as by loosening the adjusting member 44, repositioning the shoulder components 46, 48 such as by rotating, sliding or otherwise repositioning the slot of the shoulder member 46, 48 relative to the adjusting member 44, and retightening the adjusting member 44 to secure the shoulder component 46, 48 in their newly adjusted positions. The shoulder components 46, 48 may also be flexible, e.g., to allow slight bends therein to accommodate adjusting the angle or tilt of the intermediate member 34 and clamp members 36 relative to the body 14, such as to ensure that the corresponding support 16, 18 only contacts the instrument about its rim (edge) as will be described in greater detail herein.

Also, as shown in FIG. 3, a boot or covering may be applied over the intermediate member 34 and/or clamping members 36, such as may be desired to protect the instrument. For example, the covering may comprise rubber, wood, polymers, cloth, felt, leather or other material or composition of materials. The covering is not illustrated in all of the figures for clarity of discussion, but can be used with any implementation of the first and/or second supports 16, 18.

The chin rest 10 may be utilized on a variety of musical instruments. The span of the body of such instruments may vary from instrument to instrument. Moreover, depending upon how the chin rest 10 is mounted on a given instrument, it may be desirable to adjust the span between the first and second supports 16, 18 over a range of adjustable widths as will be described in greater detail below.

Figure 4:
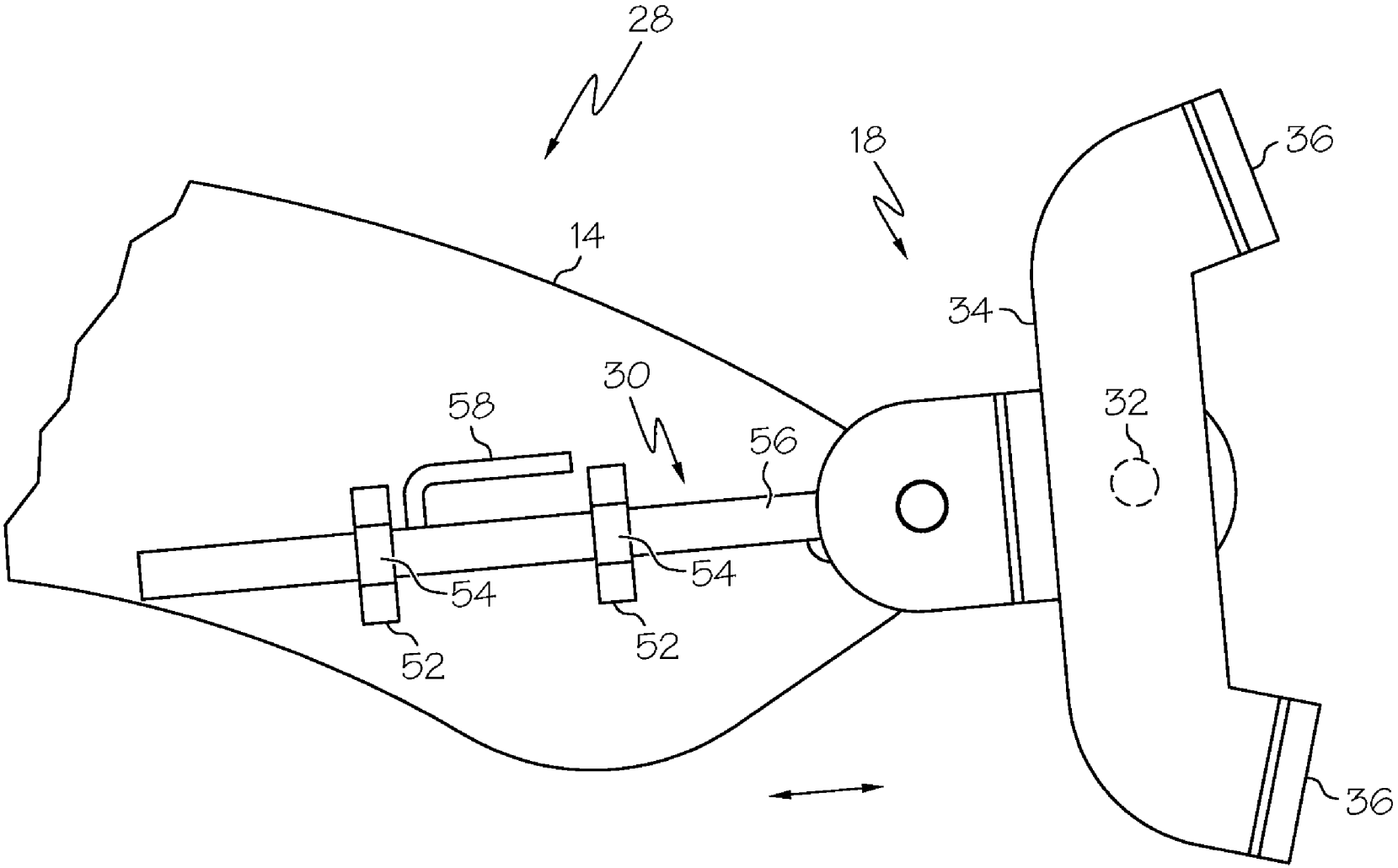
FIG. 4 is a view of another exemplary support arrangement usable with the chin rest of FIG. 1.

Referring to FIG. 4, an exemplary configuration illustrates a lateral adjustment arrangement 50 for modifying the span of the chin rest 10 between the supports 16, 18. Although a span adjusting feature is only shown with reference to one support, e.g., the second support, the described span adjusting feature or comparable arrangement for adjusting the span between the first and second supports 16, 18 may be implemented relative to the first support 16, the second support 18 or a span adjustment feature may be provided by each of the first and second supports 16, 18.

As an example, the second end portion 28 of the body 14 may include two tabs 52 that protrude outward from the underside of the body 14. Each tab 52 comprises an aperture 54 therethrough. The shoulder 30 of the support 18 comprises an extension rod 56 that extends along the body 14 and projects through the aperture 54 in each tab 52. The apertures 54 are thus dimensioned to allow the extension rod 56 to pass freely therethrough when the tabs 52 are aligned generally normal to the surface of the body 14. The extension rod 56 connects at one end to a ring, bracket or other structure for receiving the arm 32. The tabs 52 may be cut from the body 14 and bent down. The tabs 52 may also be constructed on a foot, boot or other structure that is attached to the body 14, the tabs 52 may be individually attached to the body 14, or other arrangements may be utilized to provide the tabs 52. Still further, the tabs 52 may be provided with a rubber, tubing or other suitable jacket, such as to protect a corresponding instrument, etc.

A lever 58 or other suitable arrangement may be used to interconnect the tabs 52 such that when the lever 58 is in a disengaged position, e.g., rotated in a down position normal to the surface of the body 14, the tabs 52 are also oriented normal to the surface of the body 14, allowing a user to freely reciprocate the extension rod 56 of the shoulder 30 in and out of the tabs 52. When the lever 58 is in a locked position, e.g., when the lever 58 is pivoted so as to reside generally parallel with the surface of the body 14, the tabs 52 are angled with respect to the surface of the body 14 sufficient to resist reciprocating movement of the extension rod 56. The tabs 52 may alternatively be adjusted by other means, such as manually bending each tab 52 to frictionally engage the extension rod 56. Moreover, the extension rod 56 may be flexible, allowing the user the opportunity to bend or otherwise shape the extension rod 56, and thus the shoulder 30 to a desired position with regard to the body 14. However, the extension rod 56 should not be so flexible that it significantly changes shape when the chin rest 10 is being used by a performer. The extension rod 56 may alternatively be substantially rigid and "pre-shaped", e.g., straight, curved etc.

Where the lateral (span) adjustment is provided on only one support, e.g., support 18, an alternative fixed or otherwise adjustable structure, such as that illustrated with reference to FIG. 3 may be utilized on the remainder support, e.g., the first support 16. Moreover, other techniques may be provided to allow the span between the first and second supports 16, 18 to be adjusted.

Figure 5:
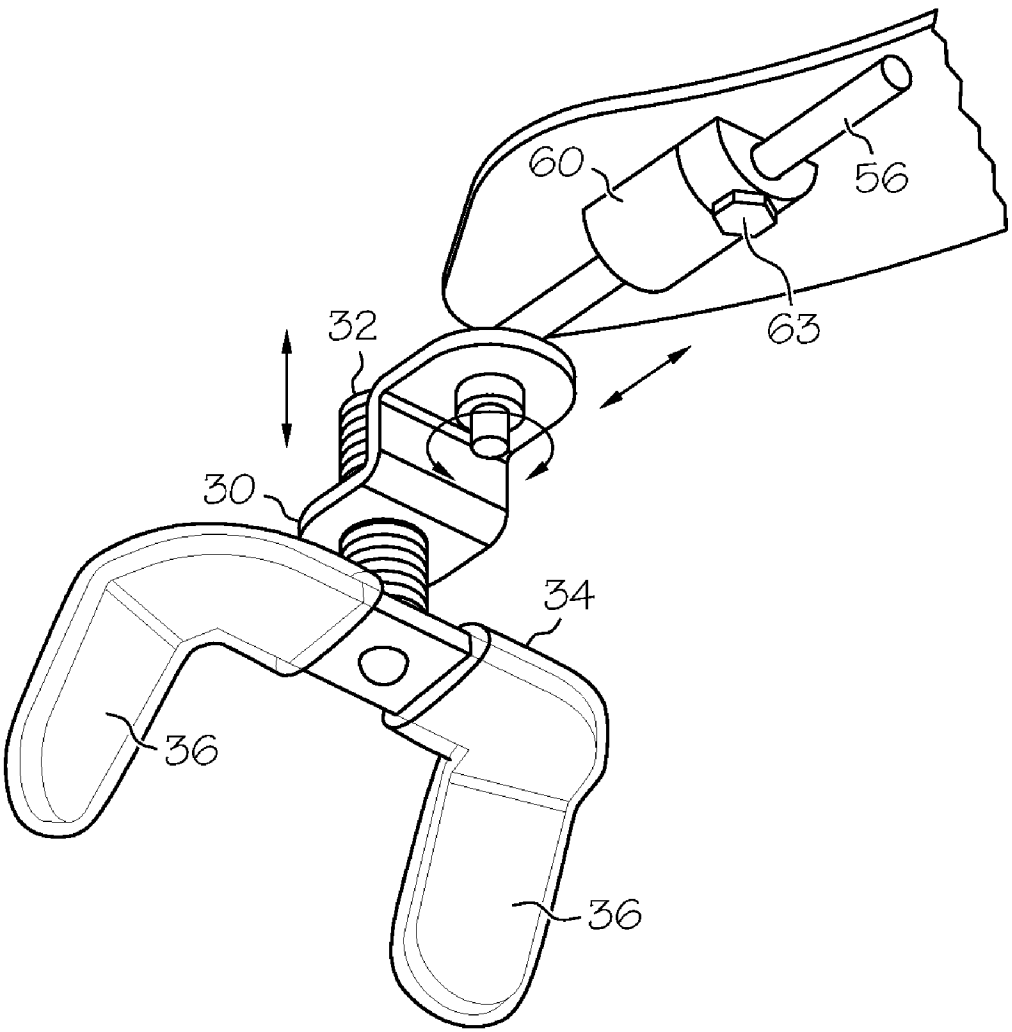
FIG. 5 is a view of yet another exemplary support arrangement usable with the chin rest of FIG. 1.

For example, with reference to FIG. 5, the extension rod 56 of the shoulder 30 may reciprocate through a barrel 60 that is fixedly coupled to the underside of the body 14. Under such an arrangement, the extension rod 56 may be locked with respect to the barrel 60 using a set screw, thumb screw or other like arrangement 63.

With reference to the figures generally, the shoulder 30 may take on any desired shape. Further, the shoulder 30 may provide play or some degree of flexibility between the clamping members 36 and the body 14 to facilitate ready mounting and removal of the chin rest 10 from an instrument as will be described in greater detail below. Moreover, the intermediate member 34 may be optional, e.g., if a single clamping member 36 is provided. Alternatively, more than two clamping members 36 or supports 16, 18 may be utilized. Still further, other techniques may be utilized to interconnect the shoulder 30, the arm 32, the intermediate member 34 and the clamping members 36.

As will be seen in greater detail below, the clamping members 36 may exert a slight pressure on the rim of a corresponding instrument when the chin rest 10 is suitably mounted thereto. Moreover, the shape and configuration of the shoulder 30, arm 32, intermediate member 34 and/or clamping member(s) 36 may vary depending upon the desired position (s) of contact with the instrument and/or desired adjustability of the chin rest 10. For example, it may be desirable that each of the supports 16, 18 contact the instrument along an upper rim or edge and not along the belly (top surface) or side wall of a corresponding instrument, thus enabling the performer to achieve a more sonorous tone by reducing and/or eliminating damping effects to the vibration of the instrument caused by the chin rest 10.

Accordingly, the shoulder 30, arm 32, intermediate member 34 and/or clamping member(s) 36 may be angled, tilted, slanted or otherwise configured to limit the areas of contact of the supports 16, 18 with a corresponding instrument. For example, as seen in FIG. 1, the intermediate member 34 may comprise an angled portion relative to the clamping member (s) 36 to minimize its contact with an instrument that the chin rest 10 is mounted to. That is, as shown, the clamping members 36 may not be oriented at a perfect 90 degree angle relative to the corresponding intermediate member 34. Moreover, the intermediate member 34 may not be configured to a perfect 90 degree angle with respect to the corresponding arm 32, thus limiting the contact area of the supports 16, 18 with an instrument that the chin rest 10 is mounted to.

The first and second supports 16, 18 may each have height adjustment features as shown. However, the first and second supports 16, 18 need not have height adjusting features. Rather, the height may be fixed at either or both of the first and second supports 16, 18. Also, arrangements other than a threaded arm 32 may be utilized to provide a height adjusting feature. For example, the arm 32 may lockably reciprocate through the female aperture 38, telescopically extend and retract, or implement other height adjusting features. Moreover, the shoulder 30 and/or the intermediate member 34 may be fixedly supported, or provide a pivoting or other rotational movement to the clamping members 36. Also, the clamping members 36 may be able to freely rotate or otherwise be repositioned relative to the body 14 to compensate for the features of the instrument to which the chin rest 10 is mounted. For example, when attaching the chin rest 10 to a curved surface of a corresponding instrument, it may be desirable to rotate or otherwise adjust the position of the clamping members 36 relative to the body 14 so that each of the clamping members 36 suitably contact the instrument about an upper edge thereof, as will be described in greater detail below.

With reference generally to FIGS. 6A, 6B, 6C, 7A and 7B generally, the chin rest 10 may be mounted on a musical instrument where it is desirable to provide a chin supporting feature to the instrument. A typical instrument 100, such as a violin or viola, includes generally, a body 102 having top surface 104, which is also sometimes referred to as a soundboard or belly, a back surface 106, a sidewall 108 that spaces the top surface from the back surface, an upper rim 110 defining the interface between the upper surface 104 and the sidewall 108 and a lower rim 112 defining the interface between the back surface 106 and the sidewall 108. The illustrated musical instrument includes a set of strings 114 that pass over a string bridge 116 and attach to a tail piece 118. The tail piece 118 includes a connecting member 120 that wraps around an end pin 122 that extends from the side wall 108, in a position generally centered along the length of the instrument 100.

The chin rest 10 is readily attachable to, and removable from, the body 102 of the musical instrument 100. In this regard, the body 14, the shoulders 30 and/or other components of the first and second supports 16, 18 may have some "play" in them, so that the chin rest 10 can be mounted onto and removed from the instrument 100. For example, the chin rest 10 may be mounted onto the instrument 100 by positioning the chin pad 12 generally to a desired position along the upper rim 110 of the instrument. By temporarily applying a slight bending force to the first support 16 and/or the second support 18, the clamping members 36 are slipped over the top surface 104 of the body 102 and are brought into contact with the upper rim 110 of the instrument 100. Thus, when installed, the chin rest 10 is held onto the instrument 100 only by the supporting force applied between the first and second supports 16, 18 via their respective clamping members 36 pressing against the upper rim 110 of the instrument 100. Moreover, the floating support 20 may rest along the upper rim 110 of the instrument 100. The chin rest 10 is likewise readily removed from the instrument 100, e.g., by pulling the first and second supports 16, 18 apart and by slipping the supports 16, 18 over and off of the instrument body 102. However, it is preferable that there is not too much play between the first and second supports 16, 18. For example, the chin rest 10 should not unintentionally release from the instrument 100, such as during use.

The first and second supports 16, 18 may include a pivoting member or feature, e.g., in the shoulder 30, arm 32 or intermediate member 34 that allows the clamping members 36 to pivot or rotate with respect to the body 14. This allows the performer a degree of flexibility when mounting the chin rest 10 on a musical instrument by having the ability to adjust the angle of the clamping members 36 relative to the body 14.

As an example, consider the chin rest 10 with reference to the instrument 100. Assume that an "x-axis" extends along the length of the instrument 100 parallel to the strings 114, a "y-axis" extends through the instrument from side to side, and a "z-axis" extends along the sides 108 in a direction from the bottom surface 106 to the top surface 104 of the instrument 100.

With particular reference to FIGS. 1, 6A-6C and 7A-7B, intermediate member 34, and therefore clamping members 36, may be able to rotate so as to compensate for the curvature of the body 102 of the instrument 100, such as to follow the contour of the upper rim 110. For example, this may be accomplished by a rotation of the arm 32 with respect to the shoulder 30, or by a rotation of the intermediate member 34 relative to the shoulder 30 and/or arm 32.

Further, as the height of the first and second supports 16, 18 and the height of the floating support 20 are (individually) adjusted, it is possible that the surface of the body 14 will not always remain in the same plane, e.g., the body 14 may lie in a different plane defined by the x-axis, the y-axis and the z-axis as adjustments are made to the first, second and third supports 16, 18, 20. Thus, the angle of the body 14, and correspondingly, the angle of the chin pad 12, can be adjusted relative to the instrument 100 to set the chin rest 10 to a position that is comfortable for the performer. As such, at least the intermediate member 34 and the clamping members 36 may be able to rotate, such as on an axis parallel to the y-axis of the instrument 100 when a support 16, 18 is mounted to an associated side of the corresponding instrument 100, such as to maintain proper contact of each of the clamping members 36 with the upper rim 110 of the instrument 100.

As another example, with particular reference to FIG. 4, the extension rod 56 may be round in cross-section. Thus, a rotation may be provided by positioning the lever 58 to the unlocked position and by turning the extension rod 56 within the apertures 54 of the tabs 52 causing the intermediate member 34 and the corresponding clamping members 36 to rotate relative to the body 14.

As noted in greater detail herein, the relative span of the clamping members 36 may also be adjusted, e.g., in the y-direction, by adjusting the extension rod 56 so as to slide the back and forth lengthwise through the apertures 54 of the tabs 52. When a suitable position is reached, the lever 58 may be returned to a locked position to constrain rotation of and extension of the clamping members 36.

Figure 6A:
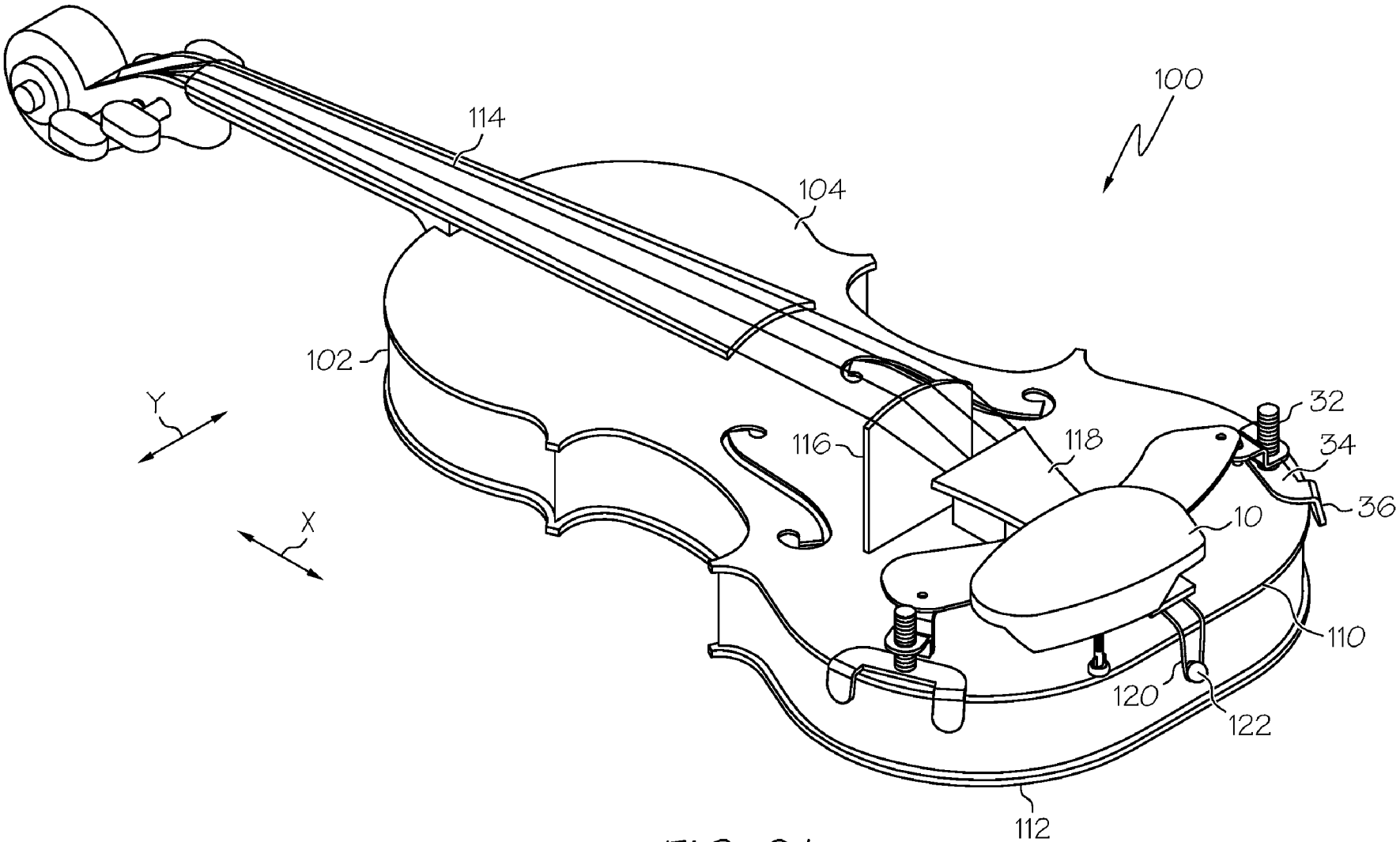
FIG. 6A is a view of the chin rest of FIG. 1 mounted on an exemplary musical instrument in a first exemplary position.
Figure 6B:
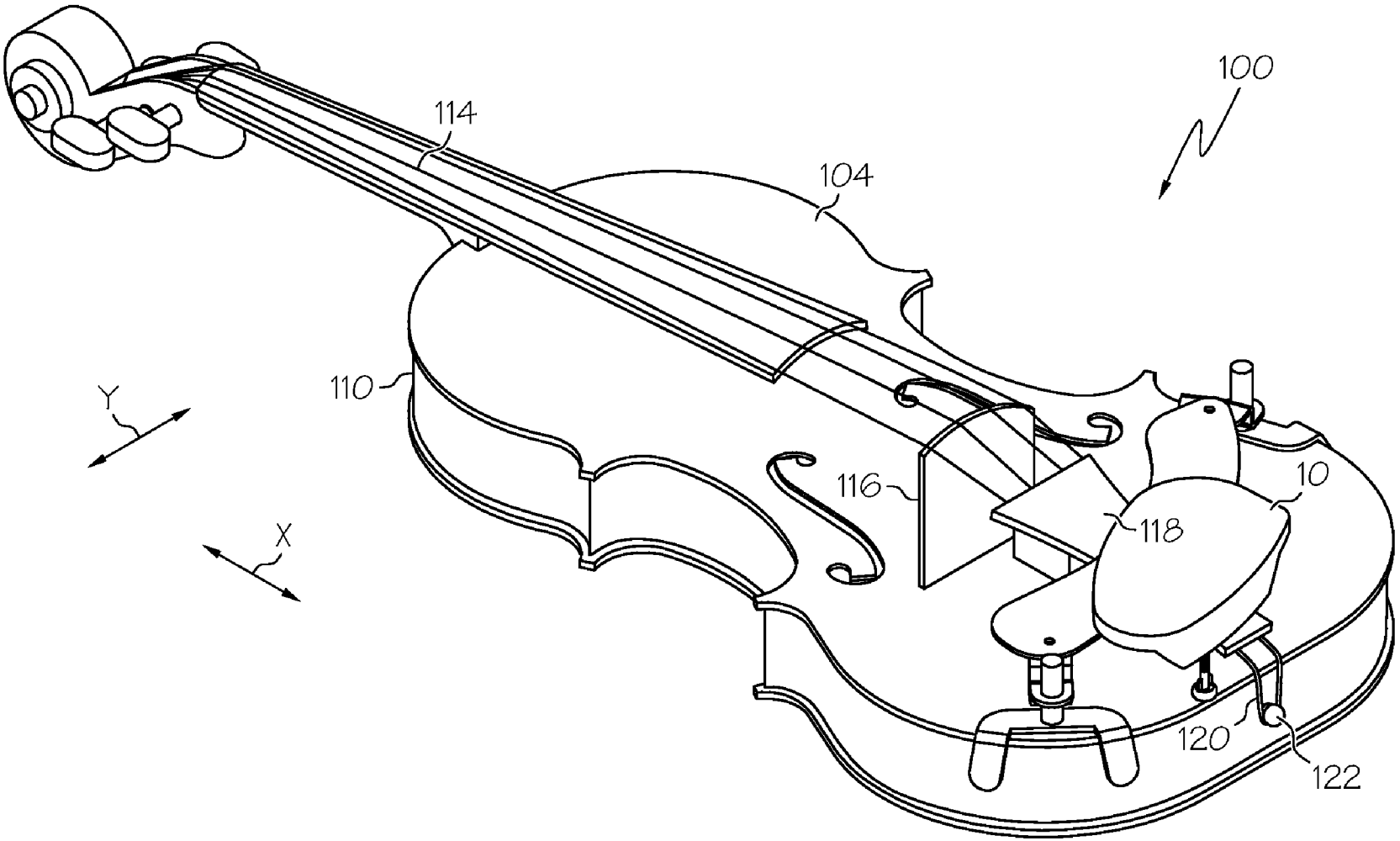
FIG. 6B is a view of the chin rest of FIG. 1 mounted on an exemplary musical instrument in a second exemplary position.
Figure 6C:
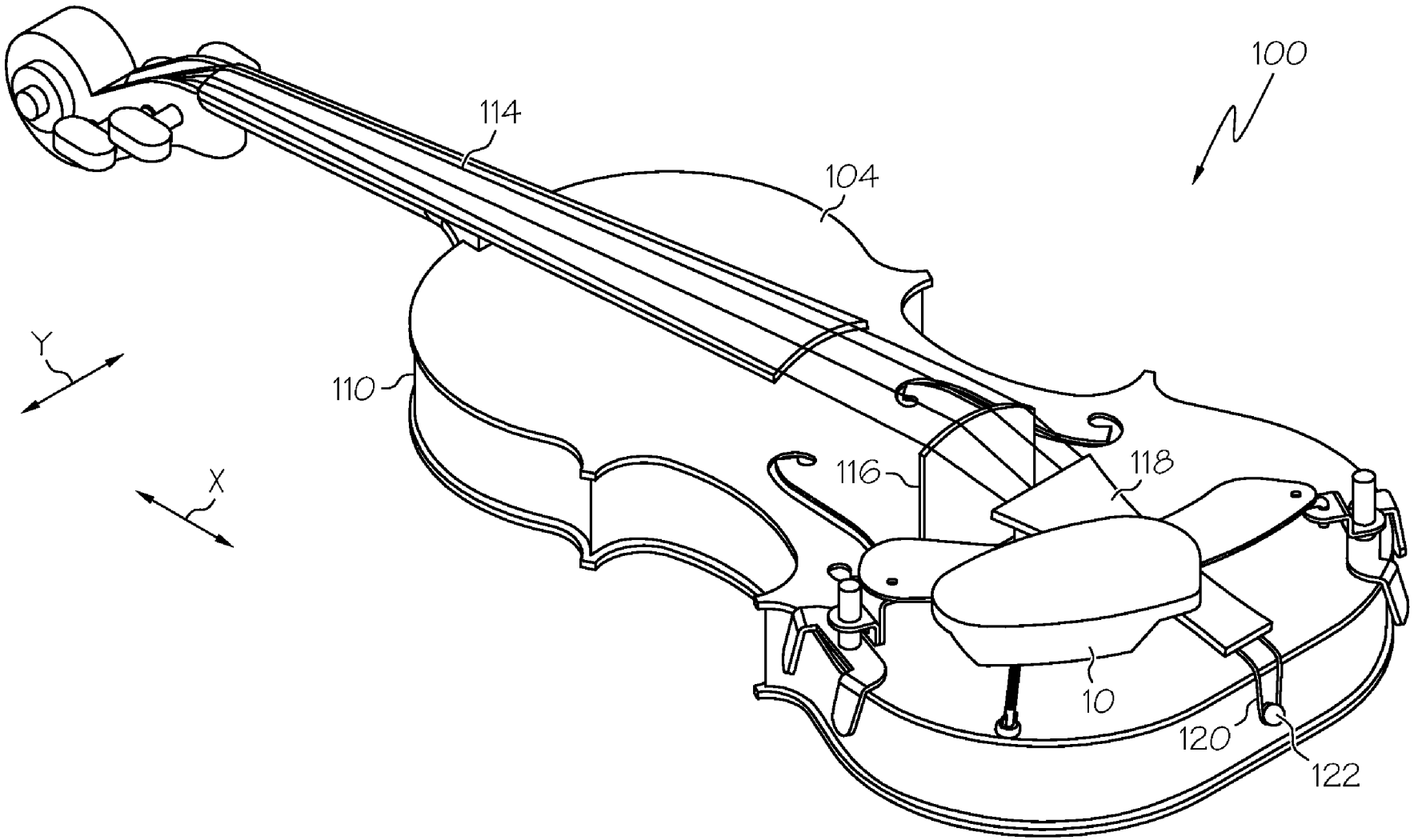
FIG. 6C is a view of the chin rest of FIG. 1 mounted on an exemplary musical instrument in a third exemplary position.
Figure 7A:
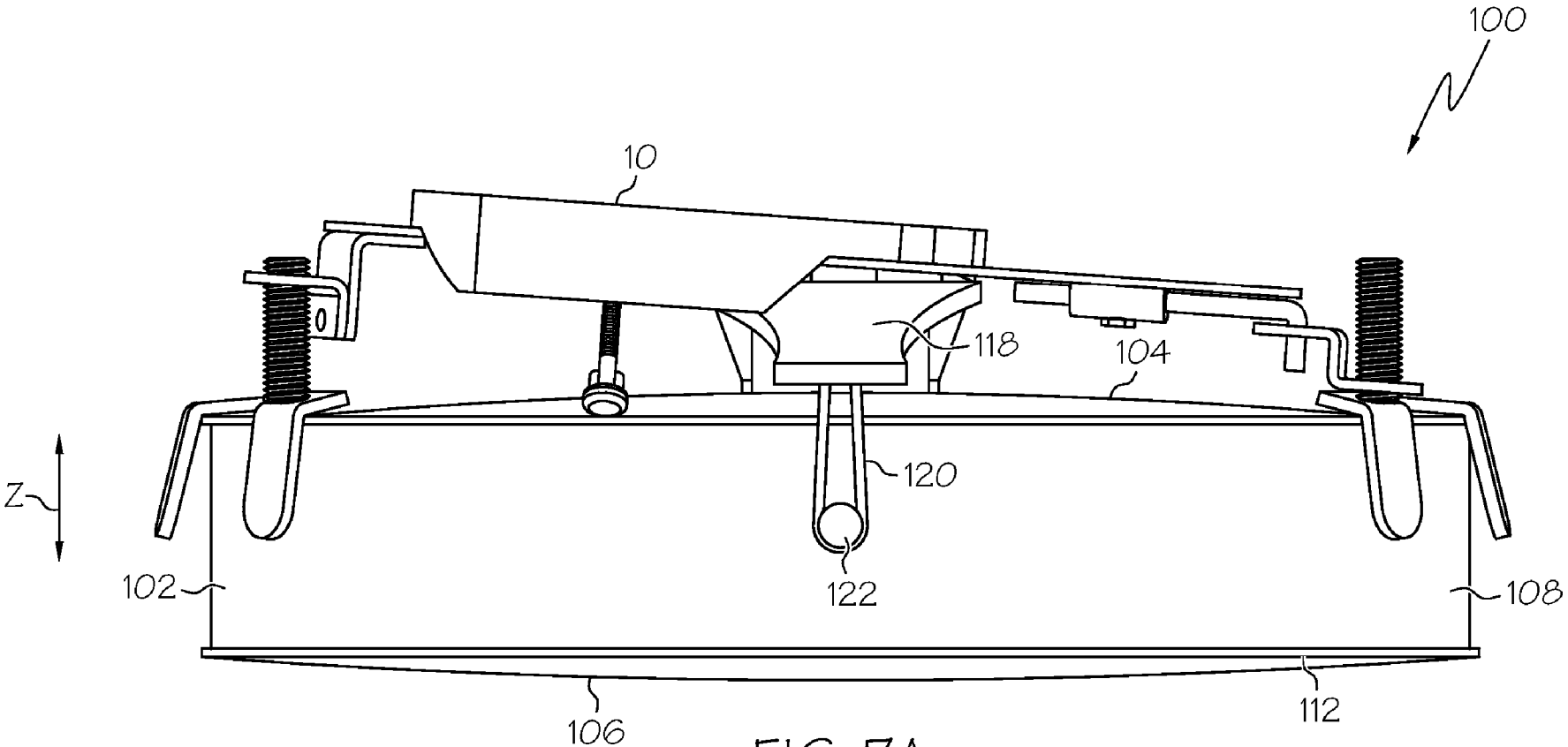
FIG. 7A is a side-end view of the instrument of FIG. 6 showing a first exemplary height adjustment of the chin rest of FIG. 1.
Figure 7B:
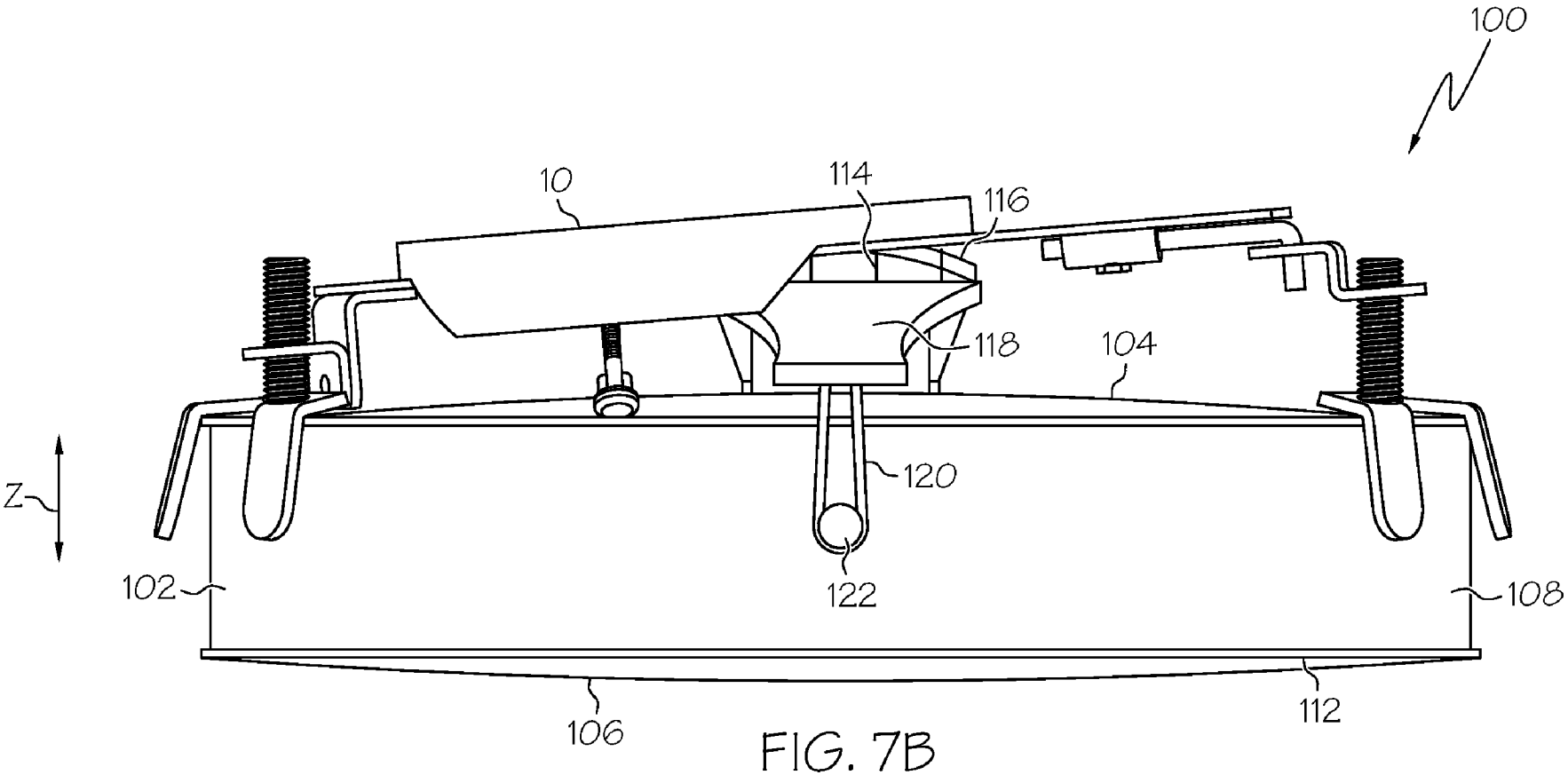
FIG. 7B is a side-end view of the instrument of FIG. 6 showing a second exemplary height adjustment of the chin rest of FIG. 1.

The intermediate member 34 and the corresponding clamping members 36 may also be able to rotate, such as on an axis parallel to the x-axis when a support 16, 18 is mounted to an associated side of the corresponding instrument 100, e.g., to optimize the contact of intermediate member 34 and/or clamping members 36 with the upper rim 110 of the instrument 100, such as may be performed, for example, by adjusting the shoulder 30 or intermediate member 34 such that contact is made substantially along the upper rim 110 of the instrument 100. For example, as seen in FIG. 6A, the intermediate member 34 lifts off of the belly 104 due to its angled attachment to the arm 32. Moreover, the clamping members 36 angle away from the side wall 108 to ensure contact along the upper rim 110. As noted above, by limiting contact to the upper rim 110 and not the belly 104, the effects of damping from the chin rest 10 can be reduced and/or eliminated.

With specific reference back to FIGS. 1, 2, 6A-6C and 7A-7B, it may also be desirable to include an adjustment feature that allows the position of the chin support surface 22 to be relocated relative to the body 14 of the chin rest 10 and/or the belly 104 of the instrument 100. For example, a performer may wish to relocate the chin support surface 22 generally in the x-direction so that the chin support surface 22 is closer to, or farther away from the back of the instrument 100. Where the floating support 20 is coupled to the chin pad 12, a feature may allow for rotation, adjustment or other repositioning of the top of the floating support 20, such as on an axis parallel to the a-axis and/or the y-axis of the instrument 100. Under this arrangement, the end cap 40 maintains a position along the upper rim 110 of the instrument, but the floating support 20 would adjust forward, backward or otherwise with the repositioning of the chin pad 12 relative to the body 14, and would allow for the performer to position support surface 22, and hence the chin of the performer either closer or farther away from the instrument 100.

For example, as best seen in FIG. 2, the third (floating support) 20 may be relocated to an angled hole 41 to allow the chin pad 12 to extend out over the belly 104 of the instrument, yet allow the floating support to maintain contact with the upper rim 110. Other arrangements may be utilized to secure and/or adjust the third support 20 to the chin pad 12 and/or body 14.

Also, as noted above, an adjustment to the position of the chin pad 12 relative to the body 14 of the chin rest 10 may be preformed by having multiple threaded openings 43 in the chin pad 12 opposite the chin support surface 22 that receive a corresponding threaded member to secure the chin pad 12 relative to the body 14. Still further, the body may have one or more slotted apertures that cooperate with the threaded openings 42. Under these arrangements, the user would match up a desired position for the chin pad 12 from one of the provided threaded openings/slots, etc. Other adjustment features, including a continuously variable adjustment feature may alternatively be provided.

With reference to FIGS. 6A, 6B, 6C, 7A, 7B generally, the chin rest 10 is illustrated mounted to an exemplary instrument 100. As is illustrated, the clamping members 36 grip the instrument 100 along the upper rim 110. Moreover, the supporting action is achieved by applying a slight force along the upper rim 110. While the entire body 102 may vibrate when being played, the upper rim 110 vibrates significantly less than the top surface 104 and the bottom surface 106. Accordingly, the first and second supports 16, 18 do not significantly dampen or otherwise interfere with the vibration of the instrument 100. This improves the overall tone experienced by the performer (and listener) as the instrument 100 is played.

Depending upon the specific implementation of the first and second supports 16, 18, the body 14 may be angled downward at the first and second end portions 24, 28, e.g., to ensure that the intermediate support 34 or other components of the supports 16, 18 do not contact the belly 104 of the instrument 100 in an area other than along the upper rim 110.

The floating support 20 also does not adversely interfere with the vibration of the instrument 100. Rather, the floating support 20 only contacts the instrument 100 by resting or floating along or proximate to the upper rim 110. Accordingly, the chin rest 10 is supported only along the upper rim 110 of the instrument 100 and it does so in such a way that the tone of the instrument is preserved by minimizing the damping effects of the vibration of the instrument body 102 caused by the chin rest 10.

As illustrated generally in the figures herein, the body 14 may span across the tail piece 118 of the instrument 100 such that the first support 16 contacts the upper rim 110 on a first side of the tail piece 118 and the second support 18 contacts the upper rim 110 on a second side of the tail piece 118, which is opposite the first side. Further the floating support 20 extends downward from generally underneath the chin pad 12 to rest on the upper rim 110 of the instrument 100. This particular arrangement is shown by way of illustration, and not by way of limitation of the possible arrangements of various aspects of the present invention.

Adjustability Features

As noted in greater detail herein, the angle of the chin pad 12 can be adjusted in numerous ways. The entire chin rest 10 can be continuously adjusted along the upper rim 110 of the body 102 of the instrument 100, e.g., by mounting the first and second supports 16, 18 of the chin rest 10 to the upper rim 110 of the instrument 100 so as to position the chin pad 12 in a desired position. Moreover, the position, tilt and/or angle of the chin rest surface 22 can be adjusted, such as forward and backwards as well as side to side, e.g., by changing the height, angle and/or tilt of one or more of the first and second supports 16, 18 or the floating support 20. Moreover, the chin support 20 may be rotated, pivoted or otherwise repositioned relative to the body 14. Certain such adjustments may be performed while the chin rest 10 is removed from the instrument 110, or while the chin rest 10 is mounted on the instrument 100. Moreover, such adjustments may be performed without tools or other additional devices such as shims, blocks, pads or other height adjusting mechanisms.

Moreover, various aspects of the present invention provide a chin rest 10 having at multi-point mounting system, e.g., defined by the first and second supports 16, 18 and the floating support 20 in one exemplary implementation. The supports 16 and 18 may provide a little play so that the chin rest 10 can be quickly and easily mounted to and removed from the instrument 100, e.g., using a single hand motion. Also, due at least in part to the multiple point support provided by the first and second supports 16, 18 and the floating support 20, adjustments to the height, tilt and other orientation of the chin pad 12 may be performed without sacrificing stability of the chin rest 10. That is, stability does not decrease as height increases.

The various aspects of the mounting system of the present invention allow considerable position adjustment capabilities of the chin rest 10 when mounted on the instrument 100. Adjustability with regard to position along the upper rim 110 of the instrument 100 may be considered generally without regard to the location of the tail piece 118 of the instrument. In this regard, the tail piece 118 may be a limiting factor with regard to the minimum realizable height of the chin rest 10, such as when the chin support surface 22 is positioned over the tail piece 118. As noted in the figures and as described more fully herein, the chin rest 10 may be mounted so that the body 14 spans across the tail piece 118 such that the first and second supports 16, 18 contact the upper rim 110 of the body 102 of the instrument 100 on opposite sides of the tail piece 118. Thus, the chin pad 12 may be positioned at any location along the upper rim 110 of the instrument 100 that is useful to the performer, including directly behind the tail piece 118 or within a predetermined range of adjustment afforded by the particular implementation of the chin rest 10 to either side of the tail piece 118. Moreover, because the first and second supports 16, 18 secure the chin rest 10 to the instrument 100 by pressing against the upper rim 110, the first and second supports 16, 18 can be positioned anywhere about the body 102 of the instrument 100 within the ranges of adjustment afforded by the particular implementation of the chin rest 10.

The chin rest 10 of the present invention provides improvement to the tonal quality of the instrument to which it is mounted, provides ready-removablity and a degree of adjustability that is significant from the perspective of the performer. The first and second supports 16, 18 as well as the floating support 20 may all be adjusted upward or downward relative to the body 102 of the instrument 100. This translates into the ability to vary not only the height of the chin pad 12, but in the ability to change the pitch, angle and other positioning features of the chin pad 12. Moreover, at least one of the first and second supports 16, 18 may be adjustable so as to allow the span or overall length of the chin rest 10 to be adjusted to accommodate instrument bodies 102 of varying size or to accommodate different orientations of the first and second supports 16, 18 relative to the upper rim 110 of a given instrument 100.

The first and second supports 16, 18 may be flexible enough to allow quick-mount and quick release of the chin rest 10 on a variety of instruments with simple adjustments. The chin rest 10 may be held to the instrument 100 by pressure applied generally in two contact areas corresponding to the locations of the first and second supports 16, 18, e.g., by pressing on the side edge of the upper rim 110. However, the first and second supports 16, 18 apply only a slight pressure to the instrument to which the chin rest 10 is mounted. Moreover, that slight pressure is applied to the upper rim 110, which vibrates significantly less than the top surface 104 and the bottom surface 106 of the instrument 100, thus having a minimum effect of tone. For example, there is no clamping between the top surface 104 and bottom surface 106 of the instrument that would otherwise dampen the vibration of the instrument body 102.

Moreover, adjustments may be performed "on the fly" in a manner that is quick and without any tools or any equipment aside from the chin rest 10 itself. Thus, a musician in a performance, finding that the chin rest 10 is not optimally positioned, can, in a small rest or between movements, make the necessary adjustments for maximum comfort and positioning.

Features from a Performer's Perspective

Certain benefits and adjustability features embodied in various aspects of the present invention may be best understood when examined from the perspective of the performer actually using the chin rest.

A performer does not always need to hold the instrument 100 completely using the chin, and therefore does not always need to apply maximum pressure to the chin rest 10. Accordingly, the instrument's sound may be dampened when a player applies pressure with the chin, but when a player is not applying such pressure, dampening may not occur and/or may lessen. That is, the mounting of the chin rest 10 is accomplished in a manner that does not apply any unnecessary pressure to the corresponding instrument 100, thus avoiding unnecessary damping of the vibration of the instrument as it is being played (unless a performer deliberately dampens the sound, such for desired sonorities).

Moreover, the floating support 20 rests on or just above the upper rim 110 and may be positioned with respect to the chin pad 12 such that downward pressure of the chin on the chin pad 12 exerts force on the instrument 100. Correspondingly, when the performer is able to release downward pressure from the chin pad 12, such as when the instrument 100 is being held and/or supported by the left hand, such pressure on the instrument 100 is relieved. Thus, the performer has the flexibility to exert and release pressure on the instrument 100 as desired. Moreover, the pressure exerted on the instrument 100 by pressure applied to the chin rest 10 can be varied by the performer, such as by modifying the pressure exerted on the chin pad 12.

The ability to adjust the height of the chin pad 12 relative to the instrument 100 provides several characteristics that differ from and/or complement raising the instrument 100 relative to the shoulder, e.g., by using a conventional shoulder rest. For example, high shoulder supports lift the instrument from the collar bone, thus removing one typically support point that may be desired by a particular performer.

Various aspects of the present invention allow playing without a shoulder rest, e.g., for practice including left hand training. Moreover, by adjusting the height of the chin pad 12, the instrument 100 may be maintained relatively close to the shoulder of the performer while still providing a chin support in a comfortable position for the performer. Raising chin pad 12 allows the use of a shoulder rest that is low enough to allow the instrument to contact the performer's collarbone or upper shoulder, which may give the performer a more secure or more comfortable hold on the instrument 100. Also, with a high chin rest 10 and low shoulder rest, the instrument 100 is lower, and therefore a performer's arm doesn't have to lift as high to reach the strings 114. Further, with a high chin rest 10 and low shoulder rest, the performer's eyes are farther from the point where the bow touches the strings (the contact point), thus making the contact point easier to view.

Occasionally, a performer may require the use of multiple instruments. Such may occur for example, when switching instruments, e.g., between violin and viola or between two of the same type of instrument, such as when borrowing, testing or evaluating an instrument, or for selecting a particular instrument for its tone, playability, aesthetic or for other performance-related reasons. Also, while a preferred instrument is undergoing repairs, it is often the case that a performer must play a different instrument.

In this regard, the chin rest 10 and/or the chin rest 10 in combination with a selected shoulder rest provides a more immediate sense of familiarity to the new instrument compared to using the setup on the previous instrument. For example, when auditioning a new instrument, the chin rest 10 may be mounted quickly and easily to the performer's optimal position.

Still further, the chin rest 10 may be periodically adjusted, such as may be desired and/or required to accommodate the changing physiology of a corresponding child musician. For example, as a child grows, a comfortable performance position may change. Moreover, the chin rest 10 may be readily used with new instruments as the child performer outgrows and/or otherwise replaces their current instrument(s). For example, a student transitioning from one rental instrument to another (or to a purchased instrument) may continue to use the same chin rest 10.

As noted in greater detail above, the chin rest 10 may allow a performer to achieve improved tone to the instrument. Moreover, the more immediate sense of familiarity obtained by using the chin rest on a variety of instruments translates to a more comfortable performance when playing a new instrument, allowing the performer to play more relaxed and generally with a higher level of skill and competency. This allows the performer the ability to concentrate on a more critical evaluation of the merits of the particular instrument, for example.

Moreover, the typical performer will find that a single fixed setup may not be ideal under all circumstances. Rather, course and/or fine adjustments may be desired on a frequent basis. For example, the material worn by the performer, e.g., a tuxedo compared to a cotton t-shirt, may affect a desired setup. Thus, a performer may compensate for changes in clothes thickness, material, composition, different collars, etc. As such, the adjustability of the chin rest 10 allows coarse to fine adjustments to be made as frequently as needed. Further, because there are no tools or extensive and difficult procedures required to perform the modification, the chin rest 10 allows adjustments to be made even in a performance setting.

The various aspects of the present invention are applicable to a variety of instruments 100, and are applicable in particular, to musical instruments that are held beneath the chin of the performer. Examples of such an instrument are the violin and viola, as well as more exotic and less common instruments, such as the viola da amore. Moreover, the adjustability of the chin rest 10 as set out in greater detail herein make it possible for a single chin rest 10 to be readily adapted to instruments 100 of varying body dimensions and characteristics. For example, the chin rest 10 may be positioned on a violin, readily removed there from without the need for tools or complicated procedures, and subsequently mounted onto a viola or other type of instrument with a few simple adjustments in an easy and efficient manner.

Also, because the adjustability of the chin rest 10, a performer who continuously varies the instrument setup, e.g., by experimenting with different chin rests and chin rest placements, can readily adapt the chin rest 10 to the desired new position. Thus, a performer who is dissatisfied, uncomfortable or otherwise inconvenienced by their current musical instrument setup can readily modify the setup.

This may be readily appreciated by performers, including teachers, students, armatures, professionals and semi-professionals who have sufficient experience to be sensitive to the effects of changes in their setup, but which have yet developed a technique that revolves around a particular fixed setup that is optimized to the particular performer.

The adjustability of the chin rest 10 allows a performer who plays regularly on more than one instrument to maintain a familiar and constant setup when changing from instrument to instrument. Similarly, where instruments are shared among multiple performers, each performer can quickly adapt the chin rest 10 to a desired setup. Moreover, a performer who is evaluating various instruments 100 may use the chin rest 10 to maintain a consistent setup allowing the performer to adequately weigh the merits of each instrument against a common and consistent set of setup conditions.

Moreover, certain performers may desire to remove the chin rest 10 completely from the instrument at select times. For example, certain practice exercises may require or otherwise be enhanced if the chin rest 10 is temporarily removed. Additionally, a performer that performs in Baroque or other period instrument ensembles may desire to remove the chin rest 10 and optional shoulder rest to provide a period accurate appearance. As an example, violinists performing in Baroque ensembles often remove their chin rest and shoulder rest because Baroque era violinists did not use them. Under such a situation, the readily removable attributes of the chin rest 10 may allow more frequent and quicker changeover.

Other features and characteristics may be added to the chin rest 10 without departing from the spirit and scope of the present invention. For example, the supports 16, 18 and the floating support 20 may be made collapsible, foldable, removable from the body 14 or otherwise adjustable for convenient storage.

Figure 8A:
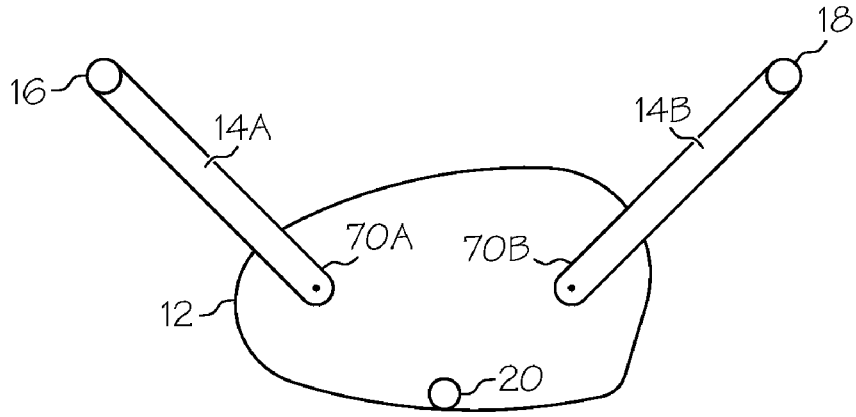
FIG. 8A is a schematic illustration of chin rest configuration.
Figure 8B:
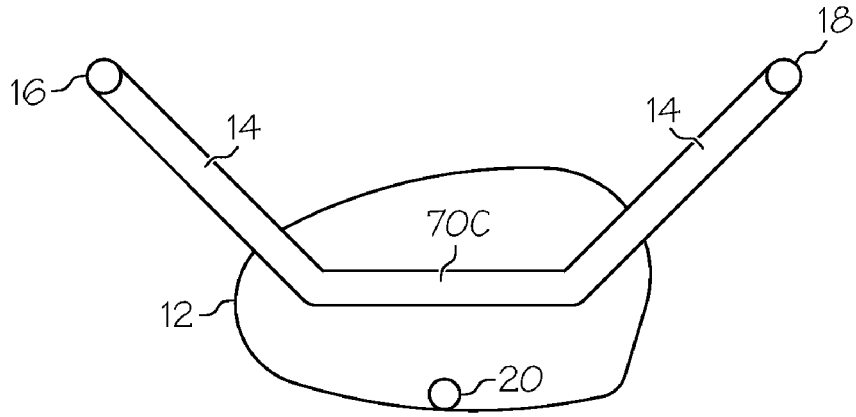
FIG. 8B is a schematic illustration of an alternative chin rest configuration.
Figure 8C:
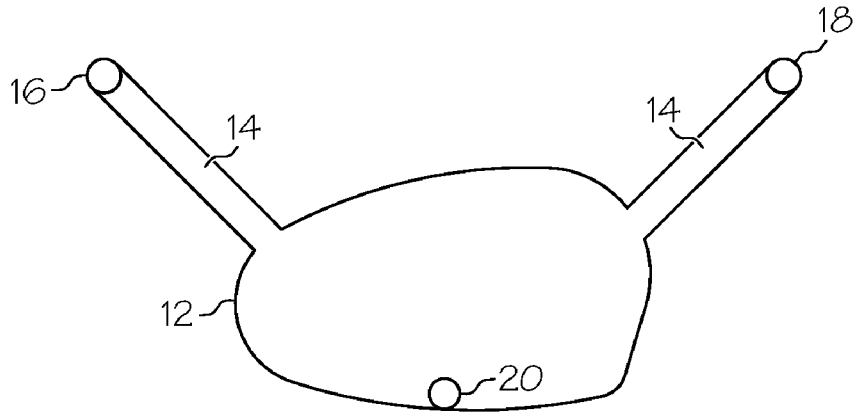
FIG. 8C is a schematic illustration of yet another alternative chin rest configuration.

Moreover, with reference to FIGS. 8A-8C, three different simplified schematic representations of the chin rest 10 are illustrated looking from the bottom view to illustrate exemplary modifications. In FIG. 8A, the body 14 has been replaced with two main arms 14A and 14B, which extend from the chin pad 12. As illustrated, the main supports 14A, 14B may be fixedly secured to the chin pad 12, or the arms 14A, 14B may be pivotably coupled to the chin pad 12, e.g., at connection 70A, 70B, respectively. Such an arrangement allows flexibility in adjusting the first and second supports 16, 18 and the chin pad 12 relative to the instrument body 102. The particular pivot points 70A, 70B are not critical and can be positioned in any convenient location. Moreover, a single pivot point may be provided, about which both arms 14A, 14B pivot, either in cooperation or independently.

An exemplary alternative arrangement in FIG. 8B illustrates a single pivot point 70C about which the chin pad 12 may rotate relative to the body 14.

The exemplary arrangement in FIG. 8C illustrates that the body 14 may be formed integral with the chin pad 12.

Stringed musical instruments such as the violin or viola may be difficult for the performer to hold. For a typical right handed performer, the instrument must be supported by either the left hand, between the chin and the shoulder, or a combination of the two. Supporting the instrument with the left hand is quite simple, but unfortunately it also restricts the ability of the performer to finger notes, so it is often necessary for a musician to have the left hand completely free.

Generally a person must find something that works by trial and error—there is no formula that can predict whether a particular setup will suit a particular musician. Having an easily adjustable chin rest 10 allows the performer a broad range of adjustability and customization options when experimenting with a setup. Moreover, no single fixed setup may ever be completely satisfactory to certain performers as particular comfortable positions may change over time.

As used herein, the term "coupled" means to link or otherwise join, fix or attach, in either a permanent or temporary manner, and includes direct coupling, e.g., a direct physical interconnection or a connection that includes one or more intermediate components, structures, elements, etc.

As used herein, the term "between" should be interpreted expansively to include relationships describing relative position that are associated spatially, but not necessarily linearly, along a definable path. For example, as shown in FIG. 6A for example, the support 20 may be considered between the supports 16, 18 along the upper rim 110 of the instrument body 102. That is, if one were to follow a trace along the upper rim 110 of the instrument body 102, a first one of the supports 16, 18 would be encountered, followed in succession by the floating support 20 and then the second one of the supports 16, 18.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to preferred embodiments thereof, it will be apparent that modifications and variations are possible without departing from the scope of the invention defined in the appended claims.

What is claimed is:

1. A chin rest for an instrument comprising:

a body having a first end portion and a second end portion that is opposite of said first end portion;

a first support extending from said first end portion of said body and a second support extending from said second end portion of said body, each of said first and second supports having at least one clamping member configured to contact an upper rim of the instrument, said first and second supports configured such that when said chin rest is mounted on the musical instrument, said clamping members are brought into contact with the upper rim of the instrument and sufficient force is applied between said first and second supports to temporarily clamp said chin rest to said musical instrument by pressing against the upper rim of the instrument;

a chin pad coupled to said body between said first end portion and said second end portion, said chin pad having a chin receiving surface; and a third support between said first end portion and said second end portion that extends from said body towards the upper rim of the instrument when the chin rest is mounted on the instrument; wherein the chin pad is adjustable in a horizontal and vertical position about a top surface of the instrument based at least in part upon an adjustable position of the first support and the second support on opposite sides of the upper rim.

2. The chin rest according to claim 1, wherein said body spans across a tail piece of said musical instrument when said chin rest is mounted thereon such that:

said at least one clamping member of said first support engages said upper rim of said musical instrument on a first side of said tail piece; and said at least one clamping member of said second support engages said upper rim of said musical instrument on a second side of said tail piece that is opposite of said first side.

3. The chin rest according to claim 1, wherein said third support comprises a floating support that extends from under said chin pad and engages said upper rim of said musical instrument at a position along said upper rim between said first and second supports when said chin rest is mounted to said musical instrument such that when said chin rest is installed on said instrument, a corresponding performer adjusts the pressure applied by said third support by varying pressure applied to the chin rest.

4. The chin rest according to claim 1, wherein at least one of said first support, said second support and said third support further comprise a height adjusting member for adjusting the position of said chin pad relative to said musical instrument when said chin rest is mounted on said musical instrument.

5. The chin rest according to claim 1, wherein said chin pad is repositionable relative to said body.

6. The chin rest according to claim 1, wherein at least one of said first and second supports is adjustable so as to adjust the span of said body.

7. The chin rest according to claim 1, wherein each of said first, second and third supports has at least one adjustment feature that cooperate to allow a user to reposition the chin pad relative to said musical instrument when said chin rest is installed on said musical instrument.

8. A chin rest for an instrument comprising:

a body;

a chin pad coupled to said body;

a first support extending from a first end portion of said body, said first support having at least one clamping member configured to contact an upper rim of the instrument and at least one adjustable feature;

a second support extending from a second end portion of said body, said second support having at least one clamping member configured to contact the upper rim of the instrument, said first and second supports configured in cooperation with said adjustable feature of said first support such that when said chin rest is mounted on the musical instrument, said clamping members are brought into contact with the upper rim of the instrument and sufficient force is applied between said first and second supports to temporarily clamp said chin rest to said musical instrument by pressing against the upper rim of the instrument in such a way that said chin pad is adjustable in a horizontal and vertical position about a top surface of the instrument based at least in part upon an adjustable position of the first support and the second support on opposite sides of the upper rim; and a third support between said first end portion and said second end portion that extends from said body towards the upper rim of the instrument when the chin rest is mounted on the instrument.

9. The chin rest according to claim 8, wherein said body spans across a tail piece of said musical instrument when said chin rest is mounted thereon such that:

said at least one clamping member of said first support engages said upper rim of said musical instrument on a first side of said tail piece; and said at least one clamping member of said second support engages said upper rim of said musical instrument on a second side of said tail piece that is opposite of said first side.

10. The chin rest according to claim 8, wherein said third support comprises a floating support that extends from under said chin pad and engages said upper rim of said musical instrument at a position along said upper rim between said first and second supports when said chin rest is mounted to said musical instrument such that when said chin rest is installed on said instrument, a corresponding performer adjusts the pressure applied by said third support by varying pressure applied to the chin rest.

11. The chin rest according to claim 8, wherein at least one of said first support, said second support and said third support further comprise a height adjusting member for adjusting the position of said chin pad relative to said musical instrument when said chin rest is mounted on said musical instrument.

12. The chin rest according to claim 8, wherein said chin pad is repositionable relative to said body.

13. The chin rest according to claim 8, wherein at least one of said first and second supports is adjustable so as to adjust the span of said body.

14. The chin rest according to claim 8, wherein each of said first, second and third supports has at least one adjustment feature that cooperate to allow a user to reposition the chin pad relative to said musical instrument when said chin rest is installed on said musical instrument.

15. A chin rest for an instrument comprising:

a body;

a first support extending from said first end portion of said body and a second support extending from said second end portion of said body, each of said first and second supports having at least one clamping member configured to contact an upper rim of the instrument, said first and second supports configured such that when said chin rest is mounted on the musical instrument, said body spans across a tail piece of said instrument, said at least one clamping member of said first support engages an upper rim of said musical instrument on a first side of said tail piece, said at least one clamping member of said second support engages said upper rim on a second side of said tail piece opposite of said first side and sufficient force is applied between said first and second supports to temporarily clamp said chin rest to said musical instrument by pressing against the upper rim of the instrument;

a chin pad coupled to said body, said chin pad having a chin receiving surface; and a third support between said first and second supports having an end portion thereof that extends from said body so as to position proximate to the upper rim of the instrument when the chin rest is mounted on the instrument; wherein the chin pad is adjustable in a horizontal and vertical position about a top surface of the instrument based at least in part upon an adjustable position of the first support and the second support on opposite sides of the upper rim.

16. The chin rest according to claim 15, wherein said third support comprises a floating support that extends from under said chin pad and engages said upper rim of said musical instrument at a position along said upper rim between said first and second supports when said chin rest is mounted to said musical instrument such that when said chin rest is installed on said instrument, a corresponding performer adjusts the pressure applied by said third support by varying pressure applied to the chin rest.

17. The chin rest according to claim 15, wherein at least one of said first support, said second support and said third support further comprise a height adjusting member for adjusting the position of said chin pad relative to said musical instrument when said chin rest is mounted on said musical instrument.

18. The chin rest according to claim 15, wherein said chin pad is repositionable relative to said body.

19. The chin rest according to claim 15, wherein at least one of said first and second supports is adjustable so as to adjust the span of said body.

20. The chin rest according to claim 15, wherein each of said first, second and third supports has at least one adjustment feature that cooperate to allow a user to reposition the chin pad relative to said musical instrument when said chin rest is installed on said musical instrument.

* * * * *